US008398437B2

(12) United States Patent
Sugami et al.

(10) Patent No.: US 8,398,437 B2
(45) Date of Patent: Mar. 19, 2013

(54) CONNECTOR AND METHOD FOR PRODUCING THE SAME

(75) Inventors: Takayuki Sugami, Yokkaichi (JP); Akinori Ooishi, Yokkaichi (JP); Akira Hattori, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 13/464,778

(22) Filed: May 4, 2012

(65) Prior Publication Data

US 2012/0216400 A1 Aug. 30, 2012

Related U.S. Application Data

(62) Division of application No. 13/001,950, filed as application No. PCT/JP2009/053862 on Mar. 2, 2009.

(30) Foreign Application Priority Data

Jul. 3, 2008 (JP) ..... 2008-174493

(51) Int. Cl.
*H01R 24/00* (2011.01)

(52) U.S. Cl. ..... 439/626; 29/808

(58) Field of Classification Search ..... 439/626, 439/687, 652, 696; 174/49; 29/809.03, 747, 29/758, 828

See application file for complete search history.

(56) References Cited

U.S. PATENT DOCUMENTS

| | | | | |
|---|---|---|---|---|
| 3,354,454 | A | 11/1967 | Rueger | |
| 3,749,604 | A * | 7/1973 | Langer et al. | 429/136 |
| 3,869,371 | A * | 3/1975 | Delves-Broughton | 204/206 |
| 3,947,343 | A * | 3/1976 | Delves-Broughton et al. | 204/207 |
| 5,133,847 | A | 7/1992 | Boyd | |
| 5,535,497 | A * | 7/1996 | Huang | 29/33 F |
| 6,083,053 | A | 7/2000 | Anderson et al. | |
| 6,126,490 | A | 10/2000 | Anderson et al. | |
| 7,574,997 | B1 * | 8/2009 | Chauza et al. | 123/538 |
| 8,151,670 | B2 * | 4/2012 | Nelson | 81/9.4 |
| 2007/0130758 | A1 * | 6/2007 | Montena | 29/747 |
| 2009/0011655 | A1 | 1/2009 | Amleshi et al. | |

FOREIGN PATENT DOCUMENTS

| | | |
|---|---|---|
| JP | 07-057813 | 3/1995 |
| JP | 07-137090 | 5/1995 |
| JP | 08-250193 | 9/1996 |
| JP | 11-031572 | 2/1999 |
| JP | 2000-251999 | 9/2000 |
| JP | 2003-089132 | 3/2003 |

OTHER PUBLICATIONS

Jan. 31, 2012 Office Action issued in U.S. Appl. No. 13/001,950.

* cited by examiner

*Primary Examiner* — Jean F Duverne
(74) *Attorney, Agent, or Firm* — Oliff & Berridge, PLC

(57) ABSTRACT

A connector having a plurality of terminals that are integrally incorporated in a connector housing, in a given arrangement, with a high degree of accuracy. The connector includes a prealigner having a plurality of terminal holding recesses, a plurality of terminals fitted into and held in the terminal holding recesses in a given alignment, and a housing main body molded so that the prealigner is interposed in the housing main body as an insert element.

6 Claims, 8 Drawing Sheets

CONNECTOR AND METHOD FOR PRODUCING THE SAME

This is a Divisional of U.S. application Ser. No. 13/001,950 filed Dec. 29, 2010 which is a National Phase of Application No PCT/JP2009/053862 filed Mar. 2, 2009 and claims priority to Japanese Patent Application No. 2008-174493, filed Jul. 3, 2008. The entire disclosures of the prior applications are hereby incorporated herein by reference in their entirety.

BACKGROUND

Technical Field

This invention relates to a connector, in particular, to a connector having a plurality of terminals that are integrally incorporated in a connector housing in a given arrangement.

SUMMARY

JP HEI 11 (1999)-31572A discloses an example embodiment of a connector in which a plurality of terminals are integrally incorporated in a connector housing in a given arrangement.

JP HEI 11 (1999)-31572A also discloses a method for producing a connector in which resin couplings for terminal support are molded on chained terminals as external elements. Further, this assembly is cut off at suitable positions to produce a terminal block, and the terminal block is integrated on a base wall of a connector housing.

However, in the connector disclosed in JP HEI 11 (1999)-31572A, when the resin couplings are molded as external elements, a stress due to a resin injection pressure remains in a contact part between the terminals and the resin. Consequently, after the resin couplings and terminals are removed from a mold, an alignment of the terminals is likely to deviate from regular positions.

An object of the present disclosure is to provide a connector in which a plurality of terminals can be integrally incorporated in a connector housing, in a given arrangement, with a high degree of accuracy.

In order to achieve the above object, a connector in accordance with a first embodiment of the present disclosure includes: a prealigner formed into a substantially square bar-like configuration and having a plurality of terminal holding recesses spaced apart from one another in a longitudinal direction of the prealigner; a plurality of terminals fitted into and held in the terminal holding recesses in a given alignment, respectively; and a housing main body molded so that the prealigner is interposed in the housing main body as an insert element. The housing main body is formed into a substantially box-like configuration in which one side is open. One end of each of the terminals protrudes in an interior of the housing main body. The other end of each of the terminals protrudes outward from the housing main body. The prealigner is integrally incorporated on a bottom of the housing main body.

Thus, when the plurality of terminals are fitted into the plurality of terminal holding recesses in the prealigner, the housing main body is molded so that the prealigner is interposed in the housing main body as the insert element. Consequently, it is possible to maintain the terminals in a given arrangement within the prealigner, with a high degree of accuracy.

In a second embodiment of a connector of the present disclosure, based on the first embodiment of the connector disclosed above, each of the terminal holding recesses is formed into a configuration in which each of the terminals can be fitted laterally.

Thus, when the terminals are fitted into the terminal holding recesses, it is possible to prevent the prealigner and terminals from being damaged. It is also possible to eliminate any waste.

In a third embodiment of a connector of the present disclosure, based on the first or second embodiment of the connector according to the present disclosure, each of the terminal holding recesses is formed into a configuration in which each of the terminals can be press-fitted.

Thus, when the terminals are press-fitted in the terminal holding recesses, it is possible to prevent the terminals from coming out of the prealigner and shifting from regular positions in the prealigner.

In a fourth embodiment of a connector of the present disclosure, based on any one of the first to third embodiments of the connector according to the present disclosure, each of the terminals is provided with a latch portion and each of the terminal holding recesses is provided with a latch-receiving portion that engages the latch portion to position the terminal in a longitudinal direction.

Thus, it is possible to prevent the terminals from coming out of the prealigner and shifting from regular positions in the prealigner.

In a fifth embodiment of a connector of the present disclosure, based on any one of the first to fourth embodiments of the connector according to the present disclosure, the terminals are formed by cutting a wire rod.

Thus, it is possible to eliminate wasted materials.

In a method for producing a connector in accordance with a sixth embodiment of the present disclosure, the method comprises the steps of: fitting a plurality of terminals into a plurality of terminal holding recesses provided in a prealigner formed into a substantially square bar-like configuration, the terminal holding recesses being spaced apart from one another in a longitudinal direction of the prealigner; and molding a housing main body so that the prealigner is interposed in the housing main body as an insert element, the housing main body being formed into a substantially box-like configuration in which one side is open. In the housing main body molding step, one end of each of the terminals protrudes in an interior of the housing main body, the other end of each of the terminals protrudes outward from the housing main body, and the prealigner is integrally incorporated on a bottom of the housing main body.

Thus, it is possible to maintain the terminals in the given arrangement within the prealigner, with a high degree of accuracy.

In a seventh embodiment of a connector of the present disclosure, based on the first embodiment of the connector of the present disclosure, the prealigner is exposed at an inner surface and an outer surface of the bottom of the housing main body.

The details of one or more implementations are set forth in the accompanying drawings and description below. Other features and advantages will become apparent from the description, drawings, and the claims.

DETAILED DESCRIPTION OF EMBODIMENTS

Figure 1:
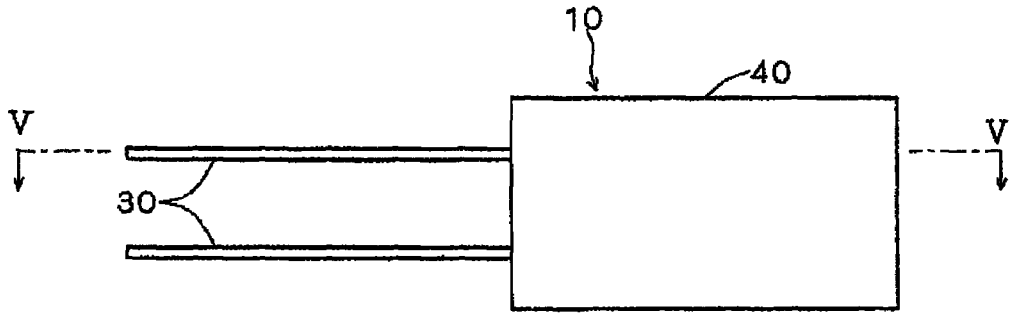
FIG. 1 is a side elevation view of an embodiment of a connector in accordance with the present disclosure.

Referring now to the drawings, embodiments of a connector in accordance with the present disclosure will be described below.

Figure 2:
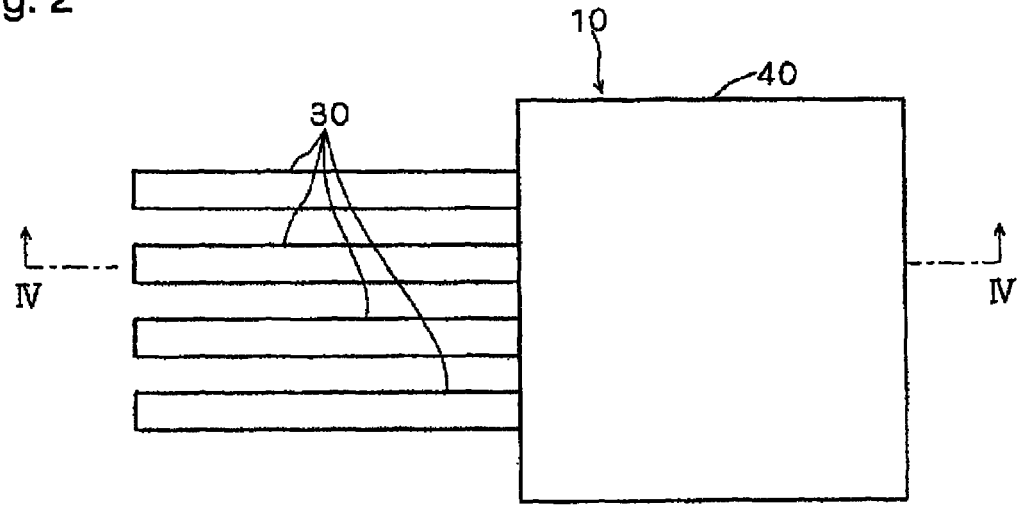
FIG. 2 is a plan view of the connector shown in FIG. 1.
Figure 3:
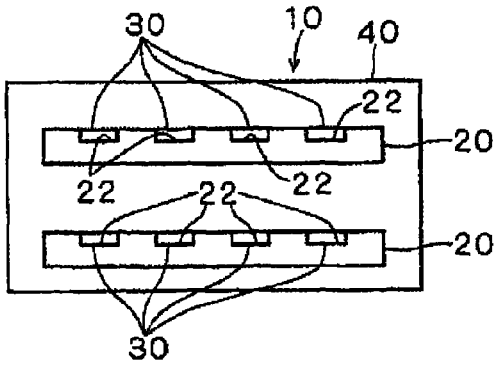
FIG. 3 is a rear side elevation view of the connector shown in FIG. 1.
Figure 4:
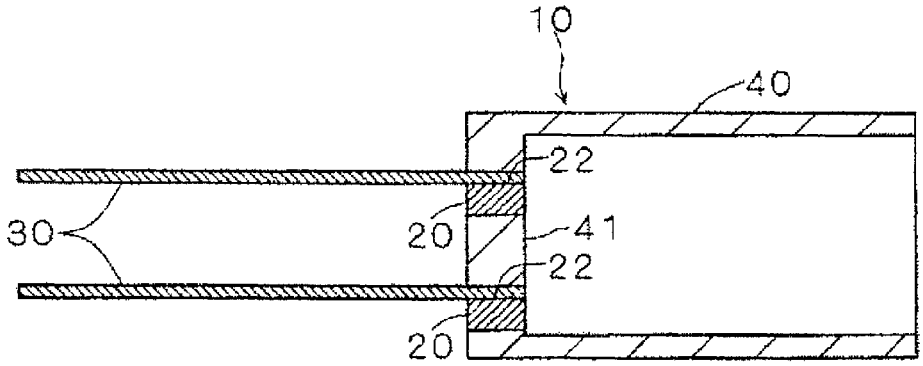
FIG. 4 is a longitudinal section view taken along lines IV-IV in FIG. 2.
Figure 5:
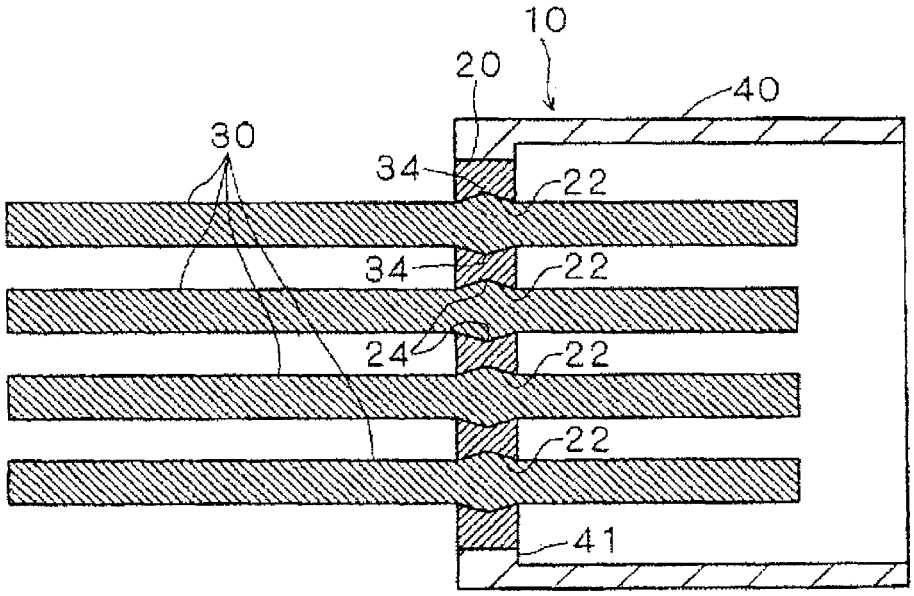
FIG. 5 is a longitudinal section view taken along lines V-V in FIG. 1.

FIG. 1 is a side elevation view of an embodiment of a connector 10 in accordance with the present disclosure. FIG. 2 is a plan view of the connector 10 shown in FIG. 1. FIG. 3 is a rear side elevation view of the connector 10 shown in FIG. 1. FIG. 4 is a longitudinal section view taken along lines IV-IV in FIG. 2. FIG. 5 is a longitudinal section view taken along lines V-V in FIG. 1.

As shown in FIGS. 1 to 5, the connector 10 includes a prealigner 20 (see FIGS. 3-5), a plurality of terminals 30, and a housing main body 40.

The prealigner 20 is made of resin or the like and is provided with a plurality of terminal holding recesses 22 in which the terminals 30 can be fitted and held.

The prealigner 20 is formed into a substantially square bar-like configuration in which a plurality of terminal holding recesses 22 are spaced apart from one another in a longitudinal direction. When the terminals 30 are held in the respective terminal holding recesses 22, the terminals 30 are supported in a given position in the recesses 22 to be spaced apart from one another.

It should be noted that forming positions and distances of the terminal holding recesses are not limited to the above construction and that the forming positions and distances of the recesses can be suitably adjusted in accordance with the number and layout of terminals. For example, the distances among the terminal holding recesses are not necessary to be uniform.

Each of the terminal holding recesses 22 is formed into a U-shaped groove that is open outward at one side of the prealigner 20 to define a side opening. Each terminal 30 is fitted through the side opening into each terminal holding recess 22 to be held in the recess 22.

Each terminal holding recess 22 is provided with a latch-receiving portion 24 that engages a latch portion 34 (discussed in detail below) of each terminal 30 to position the terminal 30 in its longitudinal direction. Each latch-receiving portion 24 is fainted into a V-shaped configuration so that each latch-receiving portion 24 extends from the side opening in the terminal holding recess 22 to an inner part on each of both side surfaces of the recess 22.

The terminal holding recesses 22 are formed into shapes adapted to receive the terminals 30 in a press-fitting manner. That is, a width of at least a part of each terminal holding recess 22 along a longitudinal direction of each terminal 30 is set to be slightly smaller than a width of each terminal 30. When the terminal 30 is press-fitted into the terminal holding recess 22, the terminal 30 can be held in the prealigner 20 by a certain holding force.

It should be noted that each terminal holding recess 22 is not limited to the above shape and that the recess 22 may be formed into any shape so long as the recess 22 can receive and hold the terminal 30. For example, the terminal holding recess 22 may be formed so that the terminal 30 can be inserted into the terminal holding recess 22 in the longitudinal direction of the terminal 30.

Each terminal 30 is made of an electrical conductive material such as metal and is formed into an elongated bar-like member. The terminal 30 may be formed by cutting a wire rod.

A latch portion 34 is provided on opposite sides of each terminal 30, in the longitudinal direction, at an intermediate part thereof. Each latch portion 34 is positioned directly across from one another when provided on each terminal 30. The latch portion 34 is formed into a V-shaped projection adapted to be fitted in the latch-receiving portion 24 mentioned above. The latch portion 34 can be formed by, for example, pressing a part of the terminal 30. Each terminal 30 is inserted laterally into each terminal holding recess 22 so that the pair of latch portions 34 are fitted into the latch-receiving portions 24. Then, the terminal 30 is positioned in the longitudinal direction and is held in a given alignment in the terminal holding recess 22.

However, it should be noted that the terminal 30 is not limited to the example in which the terminal 30 is made of the wire rod. For example, the terminal 30 may be formed by punching and bending an electrical conductive sheet.

The housing main body 40 is molded from resin so that the prealigners 20 are interposed in the main body 40 as insert elements. More specially, the housing main body 40 is formed into a box-like configuration in which one side is open. The prealigners 20 are integrally incorporated in a bottom 41 of the housing main body 40 and the terminals 30 held in the prealigners 20 extend inward and outward from the housing main body 40 to be held in a given arrangement with respect to the main body 40. Two prealigners 20 are juxtaposed in the housing main body 40 and the terminals 30 are arranged in two lines. The numbers and arrangements of the terminals and prealigners can be suitably altered in accordance with a construction of required connectors.

The terminal holding recesses 22 are open at the side of the prealigner 20. Thus, when the housing main body 40 is molded, resin will flow into the mold to close the side openings in the terminal holding recesses 22. Accordingly, in the final step, three side surfaces of each terminal 30 contact with three inner side surfaces of each terminal holding recess 22 and the remaining side surface of the terminal 30 contacts with resin flowed into and solidified in the side opening in each terminal holding recess 22, so that the terminal 30 is held in the housing main body 40. Consequently, the terminals 30 are incorporated in the connector 10 by a holding force substantially similar to that exerted by means of insert-molding into a resin molding product.

The connector 10 constructed above can be used as, for example, a PCB (Printed Circuit Board) connector. That is, if a portion of each terminal 30 that protrudes outward from the bottom 41 of the housing main body 40 is used as a soldering lead, the connector 10 can be mounted and fixed on the PCB. Another portion of each terminal 30 that protrudes in the housing main body 40 can be used as a connector terminal to be connected to a mating connector. That is, when the mating connector is attached to an end of a wire harness or the like, an arranging wire material is connected to the connector 10. Connector terminal portions of the terminals 30 in the connector 10 are then interconnected to connector terminal portions of the mating connector. Thus, various kinds of electrical elements and electrical wirings on the PCB are electrically connected to the wire harness.

The connector 10 can be used as, for example, a connecting element between the PCB of an electrical control unit (ECU), to be utilized in a motor vehicle, and a wire harness for the motor vehicle. However, the connector 10 in the present embodiment can be applied to a connector having a construction in which terminals are integrally incorporated in a resin connector housing.

A method for producing the connector 10 will be described below.

Figure 6:
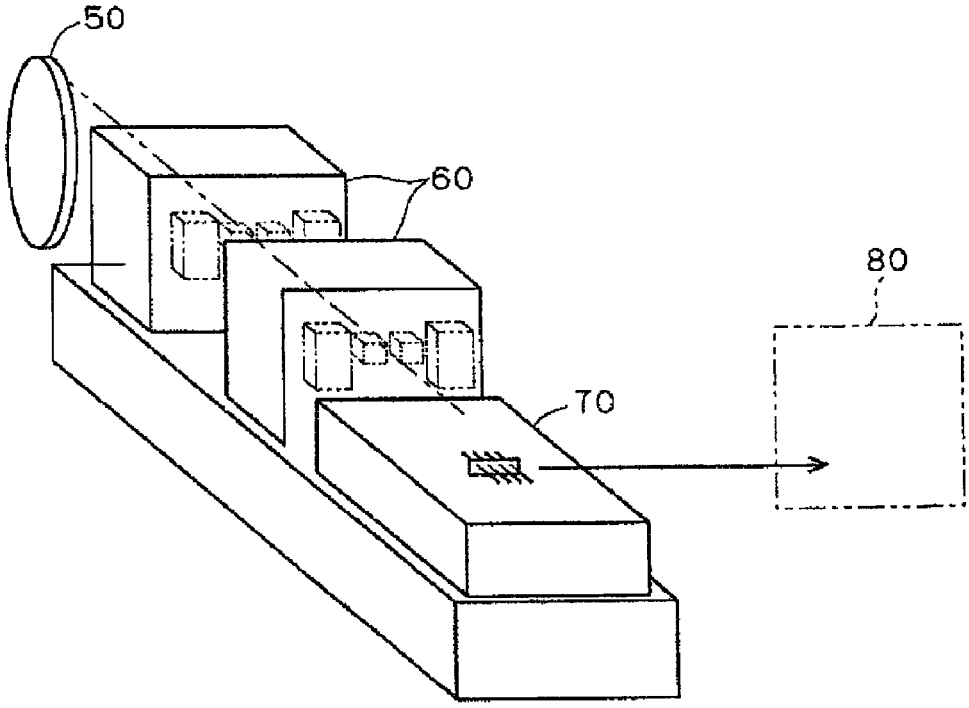
FIG. 6 is a schematic perspective view of a connector producing apparatus.

FIG. 6 is a schematic perspective view of an apparatus for producing the connector 10. FIGS. 7 to 10 show steps of producing the connector 10.

As shown in FIG. 6, an apparatus for producing the connector 10 includes a wire rod supply unit 50, a wire rod working device 60, a terminal press-fitting device 70, and a molding device 80.

The wire rod supply unit 50 includes a reel around which a wire rod is wound to be cut off as terminals. The wire rod is supplied from the wire rod supply unit 50 continuously.

The wire rod working device 60 applies a given force to a wire rod, supplied from the wire rod supply unit 50, either continuously or intermittently to work the wire rod into a given shape in cross section or into the latch portions 34 mentioned above. This wire rod working device 60 itself has various kinds of constructions including a well known working device.

The wire rod worked into the given shape by the wire rod working device 60 is supplied to the terminal press-fitting device 70 to be cut off into a given length. Thus, the respective terminals 30 are obtained.

Figure 7:
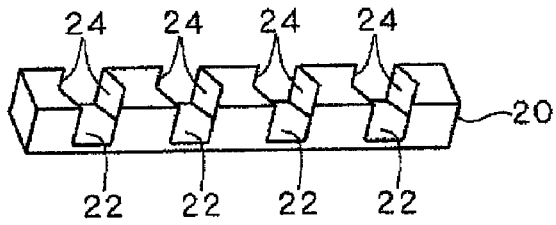
FIG. 7 is an explanatory view of a connector producing process.
Figure 8:
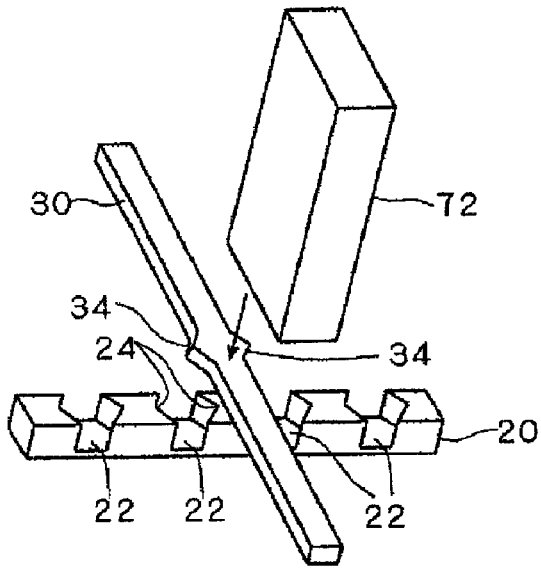
FIG. 8 is an explanatory view of a connector producing process.
Figure 9:
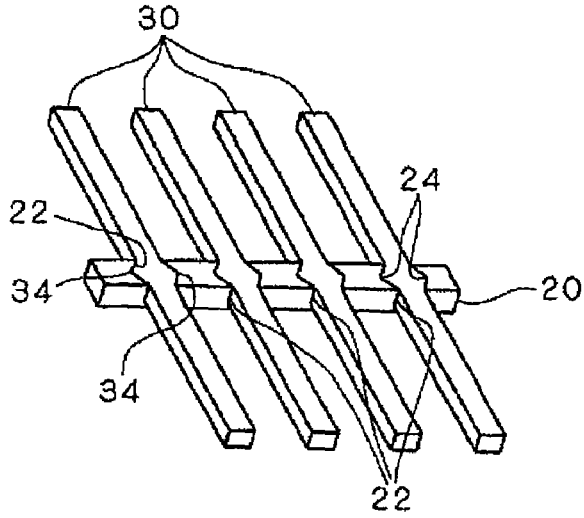
FIG. 9 is an explanatory view of a connector producing process.

On the other hand, the prealigner 20 is separately produced using a resin molding device or the like, and is prepared for producing the connector 10 (see FIG. 7). The prealigner 20 is supplied to the terminal press-fitting device 70.

The terminal press-fitting device 70 approaches the side openings in the terminal holding recesses 22 of the prealigner 20 and moves a terminal pushing-in tool 72 (see FIG. 8) to the side openings in the terminal holding recesses 22 by an actuator (not shown) such as an air cylinder, with the cut terminals being held temporarily in the device 70. The terminal pushing-in tool 72 pushes the terminals 30 into the terminal holding recesses 22. Thus, the terminals 30 are press-fitted into and are held in the terminal holding recesses 22. This operation is repeated, so that the plural terminals 30 are press-fitted into and are held in the respective terminal holding recesses 22 (see FIG. 9).

Thus, the prealigner 20 holding the terminals 30 is transported to the molding device 80.

Figure 10:
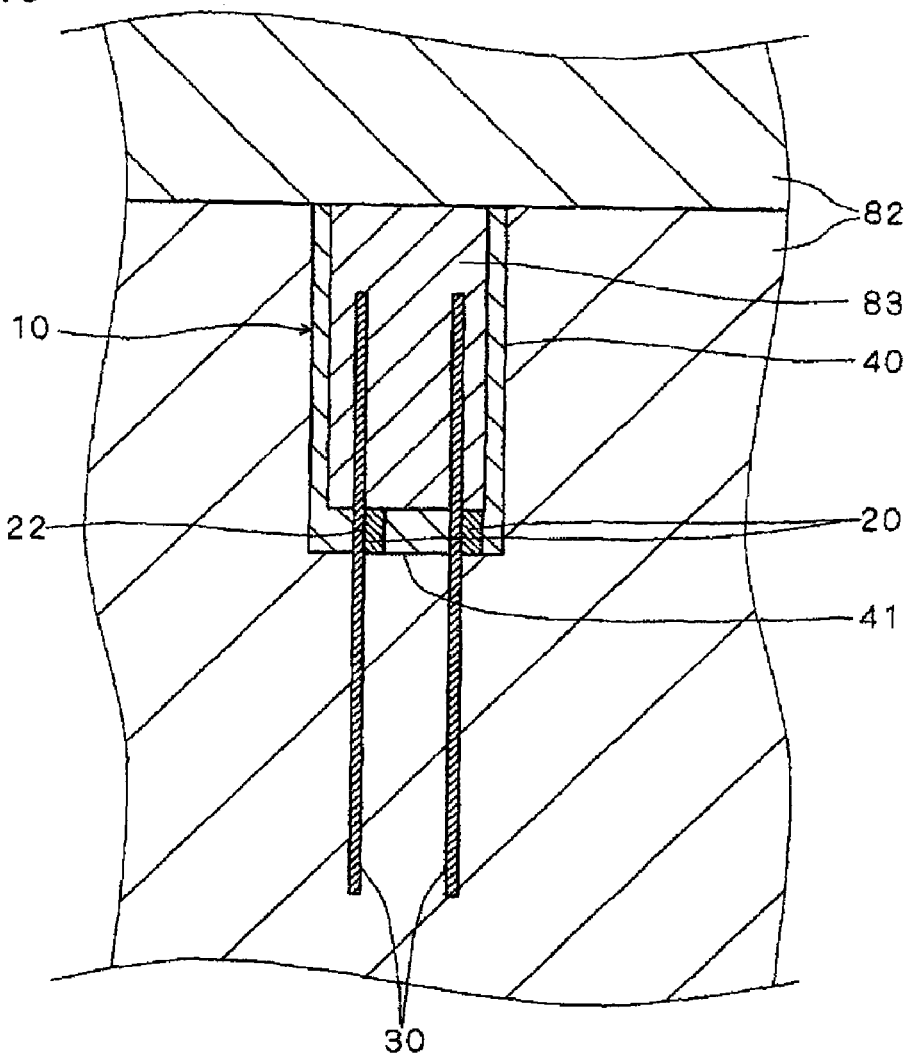
FIG. 10 is an explanatory view of a connector producing process.

The molding device 80 molds the housing main body 40 while interposing the prealigner 20 in resin as an insert element (see FIG. 10). That is, after the prealigner 20 and the terminals 30 held on the prealigner 20 are secured to molds 82 and a core 83, molten resin is poured into a space within the molds 82. After solidifying the molten resin, the molds 82 are released and the prealigner 20, terminals 30, and housing main body 40 are taken out from the released molds 82. Thus, the producing process of the connector 10 is finished.

The device for producing the prealigner 20 and the molding device 80 may be provided on different places from the press-fitting device 70 or the like. Even if they are disposed on the different places from the device 70, since the prealigner 20 or prealigner 20 holding the terminals 30 are easy to handle, they can be transported as half-finished products.

According to the connector 10 constructed above and the method of producing the same, a plurality of terminals 30 are fitted and held in a plurality of terminal holding recesses 22 in the prealigner 20, and the housing main body 40 is molded so that the prealigner 20 is interposed in the housing main body 40 as an insert element. Thus, it is possible to maintain the plural terminals 30 in a given arrangement with a high degree of accuracy in the housing main body 40. That is, after forming the prealigner 20, the prealigner 20 holds the terminals 30. Therefore, it is possible to prevent a deviation in the alignment of the terminals. This deviation is possibly caused by a residual stress in the prealigner 20 immediately after its formation. Even if a residual stress in the housing main body 40, which forms immediately after its formation, affects the terminals 30, the terminals 30 are held in the terminal holding recesses 22 in the prealigner 20. More specially, since three sides of each terminal 30 are surrounded by the terminal holding recess 22, the positions and orientations of the terminals 30 are rarely, if at all, subject to the deviation. Thus, it is possible to restrain the deviation in alignment of the terminals 30.

Under the final condition of the connector 10, since the terminals 30 are fitted in the terminal holding recesses 22 and are held in the recesses 22, with the terminals 30 contacting with the resin flowed into and solidified in the side openings in the terminal holding recesses 22, it is possible to hold the terminals 30 in the housing main body 40 firmly and strongly. Since it is possible to prevent a damage caused on account of incorporation of the terminals 30 and to prevent an occurrence of resin chippings, a connector having a high quality can be obtained.

JP HEI 11 (1999)-31572A discloses that the chained terminals must be cut off from one another after forming the connector housing. However, in the connector 10 of the present disclosure, since the terminals 30 are separated from one another originally, a cutting work of the terminals is not required. Accordingly, a production of the connector can be facilitated and waste of materials can be eliminated.

Since the terminals 30 are fitted into the terminal holding recesses 22 laterally, it is possible to reduce contact areas between the terminals 30 and the prealigner 20 in comparison with the case where the terminals are fitted into the prealigner in a longitudinal direction. Consequently, it is possible to prevent the prealigner 20 and terminals 30 from being damaged and to prevent the prealigner 20 from causing chippings on account of insertion of the terminals 30.

Since each terminal holding recess 22 is formed into a configuration suitable for receiving each terminal 30 in a press-fitting manner, it is possible for the recess 22 to firmly hold the terminal 30. In particular, it is possible to prevent the terminal 30 from coming out from the prealigner 20 and shifting in the prealigner 20 before or during forming the housing main body 40.

Since each terminal 30 is provided with the latch portions 34, each terminal holding recess 22 is provided with the latch-receiving portions 24, and the terminal holding recess 22 is positioned in the longitudinal direction when the latch portions 34 are engaged with the latch-receiving portions 24, it is possible to prevent the terminal 30 from being shifted in the longitudinal direction when producing the connector 10 and after finishing the connector 10.

Since the terminal 30 is formed by cutting off the wire rod, it is possible to eliminate wastes of material in comparison with the case where the terminal is formed by punching and pressing a metal sheet or the like.

The configurations of the latch portions 34 of each terminal 30 and the latch-receiving portions 24 of each terminal holding recess 22 are not limited to the configurations in the above embodiment.

Figure 11:
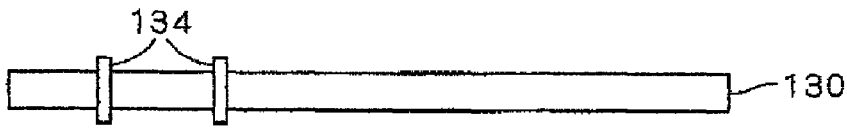
FIG. 11 is a side elevation view of a first modified embodiment of a terminal.
Figure 12:
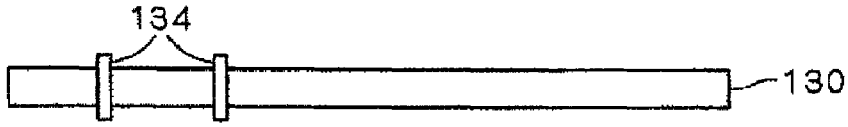
FIG. 12 is a plan view of the first modified embodiment of the terminal.
Figure 13:
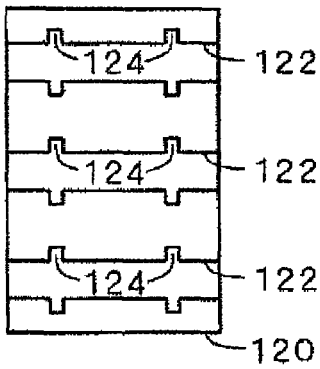
FIG. 13 is a plan view of a first modified embodiment of a prealigner.

In an alternative embodiment shown in FIGS. 11-13, a terminal 130 is provided with a plurality of latch portions 134 (two projections, here) spaced apart from one another in a longitudinal direction. Each latch portion 134 is formed into a substantially square flange-like configuration that protrudes around a whole outer peripheral surface of the terminal 30. Each terminal holding recess 122 in a prealigner 120 is provided with a plurality of groove-like latch-receiving portions 124 (two portions, here) at the positions corresponding to the latch portions 134. When the latch portions 134 are fitted into and engaged with the latch-receiving portions 124, the terminal 130 is positioned in the longitudinal direction, as is the case with the above embodiment.

Figure 14:
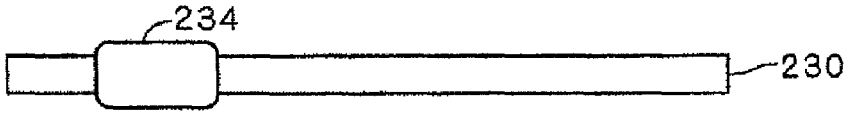
FIG. 14 is a side elevation view of a second modified embodiment of a terminal.
Figure 15:
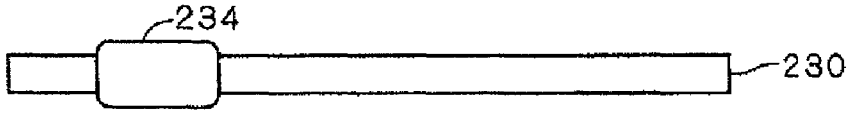
FIG. 15 is a plan view of a second modified embodiment of the terminal.
Figure 16:
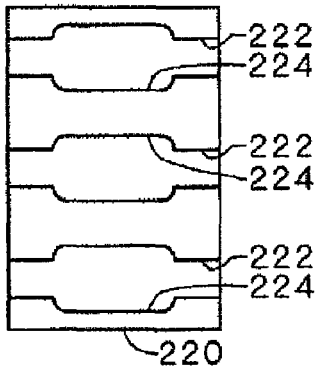
FIG. 16 is a plan view of a second modified embodiment of a prealigner.

In another alternative embodiment shown in FIGS. 14-16, a terminal 230 is provided with a single latch portion 234. The latch portion 234 has a large width part that extends through a given length at an intermediate section in a longitudinal direction. Each terminal holding recess 222 in a prealigner 220 is provided with a groove-like latch-receiving portion 224 having a given width corresponding to the latch portion 234. When the latch portion 234 is fitted into and engaged with the latch-receiving portion 224, the terminal 230 is positioned in the longitudinal direction, as is the case with the above embodiment.

Figure 17:
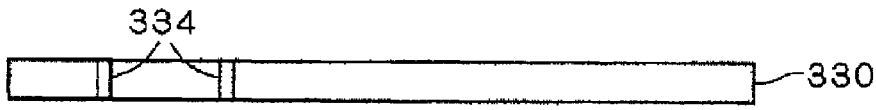
FIG. 17 is a side elevation view of a third modified embodiment of a terminal.
Figure 18:
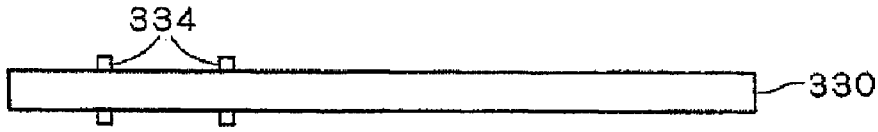
FIG. 18 is a plan view of the third modified embodiment of the terminal.
Figure 19:
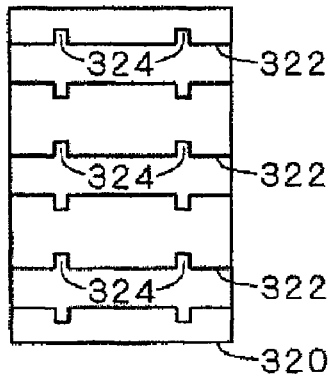
FIG. 19 is a plan view of a third modified embodiment of a prealigner.
Figure 20:
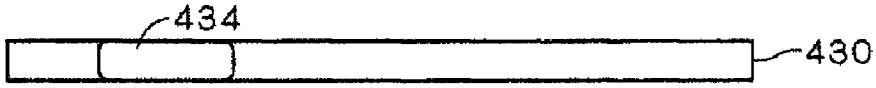
FIG. 20 is a side elevation view of a fourth modified embodiment of a terminal.
Figure 21:
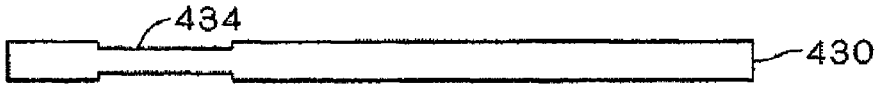
FIG. 21 is a plan view of the fourth modified embodiment of the terminal.
Figure 22:
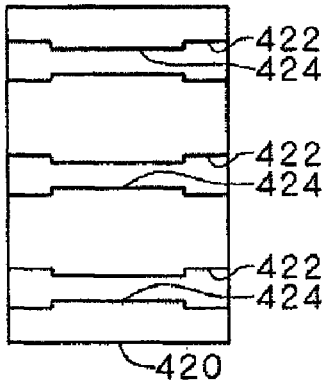
FIG. 22 is a plan view of a fourth modified embodiment of a prealigner.

In an alternative embodiment shown in FIGS. 17-19, a terminal 330 is provided with a plurality of latch portions 334 (two projections, here) spaced apart from one another in a longitudinal direction. Each latch portion 334 extends in a direction perpendicular to a longitudinal direction of each terminal 330 on each of both sides of each terminal 330 to form a rib-like configuration. Each terminal holding recess 322 in a prealigner 320 is provided in opposed side surfaces with a plurality of concaved latch-receiving portions 324 (two portions, here) at the positions corresponding to the latch portions 334. When each latch portion 334 is fitted into and engaged with each latch-receiving portion 324, the terminal 330 is positioned in the longitudinal direction, as is the case with the above embodiment.

In another alternative embodiment shown in FIGS. 20-23, a terminal 430 is provided with a single latch portion 434. The latch portion 434 has a narrow width part (specifically, a flat depression part) that extends through a given length at an intermediate section in a longitudinal direction. Each terminal holding recess 422 in a prealigner 420 is provided with a platform-like latch-receiving portion 424 having a given width corresponding to the latch portion 434. When the latch portion 434 is fitted into and engaged with the latch-receiving portion 424, the terminal 430 is positioned in the longitudinal direction, as is the case with the above embodiment.

As described above, shapes, positions, and numbers of the latch portion and latch-receiving portion can be altered in various manners. The relationship in projection and depression between the latch portion and the latch-receiving portion may be reversed. In summary, the configurations of the latch portion and latch-receiving portion can be altered so long as the latch portion of the terminal is engaged with the latch-receiving portion of the terminal holding recess to position the terminal in the longitudinal direction.

Figure 23:
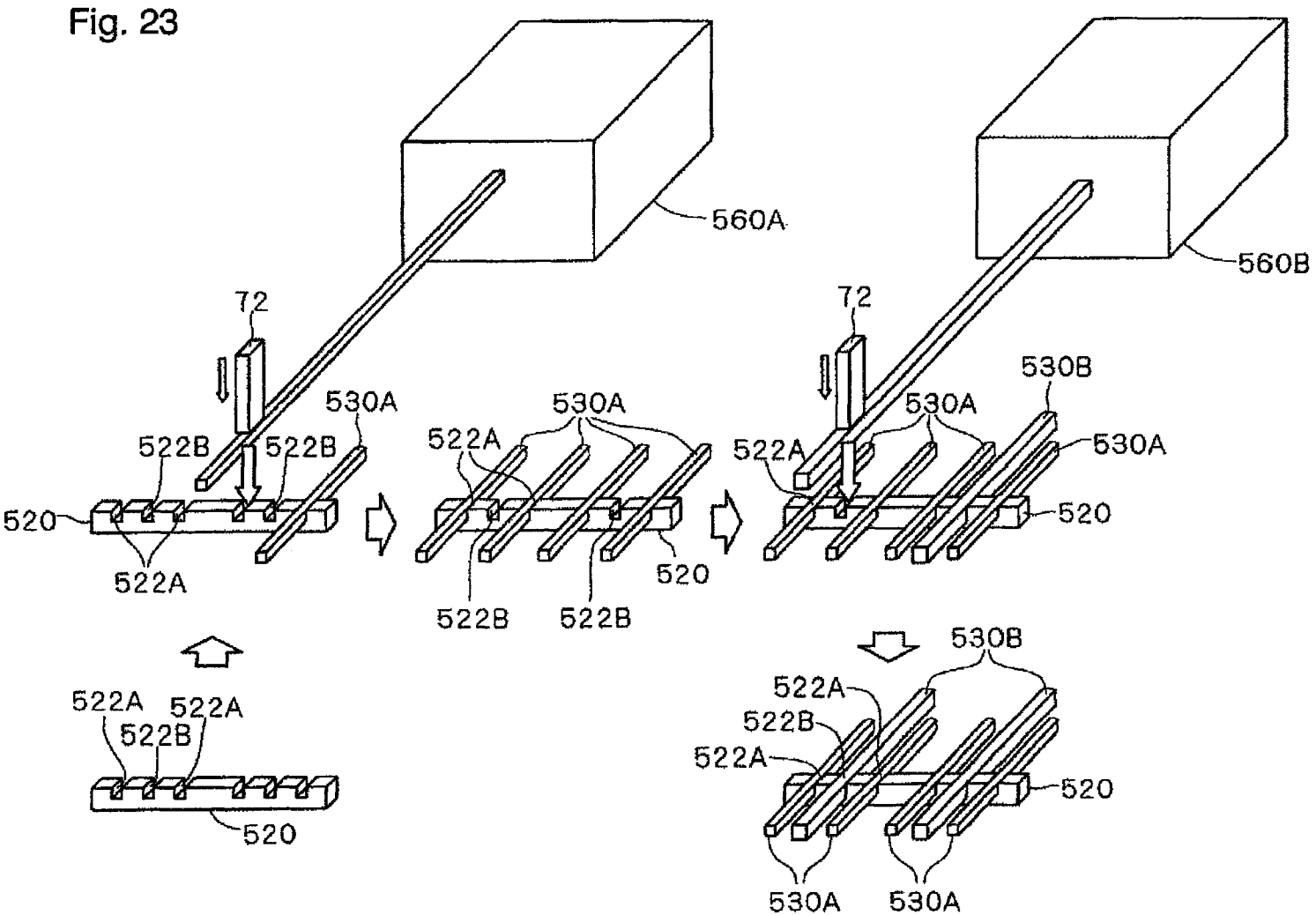
FIG. 23 is an explanatory view of connectors in which a plurality of kinds of terminals are incorporated.

FIG. 23 shows a modified embodiment in which a plurality of terminals 530A, 530B, . . . are incorporated in a connector.

For example, in the case where the terminal 530B has a larger width and longer length than the terminal 530A, an aligner 520 can be provided with terminal holding recesses 522A and 522B for holding the terminals 530A and 530B. Pitches between the terminal holding recesses 522A and 522B may be uneven.

The terminal 530A produced in a wire rod working device 560A for forming the terminal 530A is press-fitted into the terminal holding recess 522A in the prealigner 520. Then, the terminal 530B produced in a wire rod working device 560B for forming the terminal 530B is press-fitted into the terminal holding recess 522B in the prealigner 520.

Then, if the housing main body is molded so that the prealigner 520 holding the terminals 530A and 530B is interposed in the housing main body as an insert element, as is the case with the above embodiment, it possible to produce a connector in which a plurality of kinds of terminals 530A and 530B are incorporated.

Thus, even if the terminals 530A and 530B having different sizes such as diameters and lengths are mixed in the housing main body, it is possible to easily produce the connector.

Figure 24:
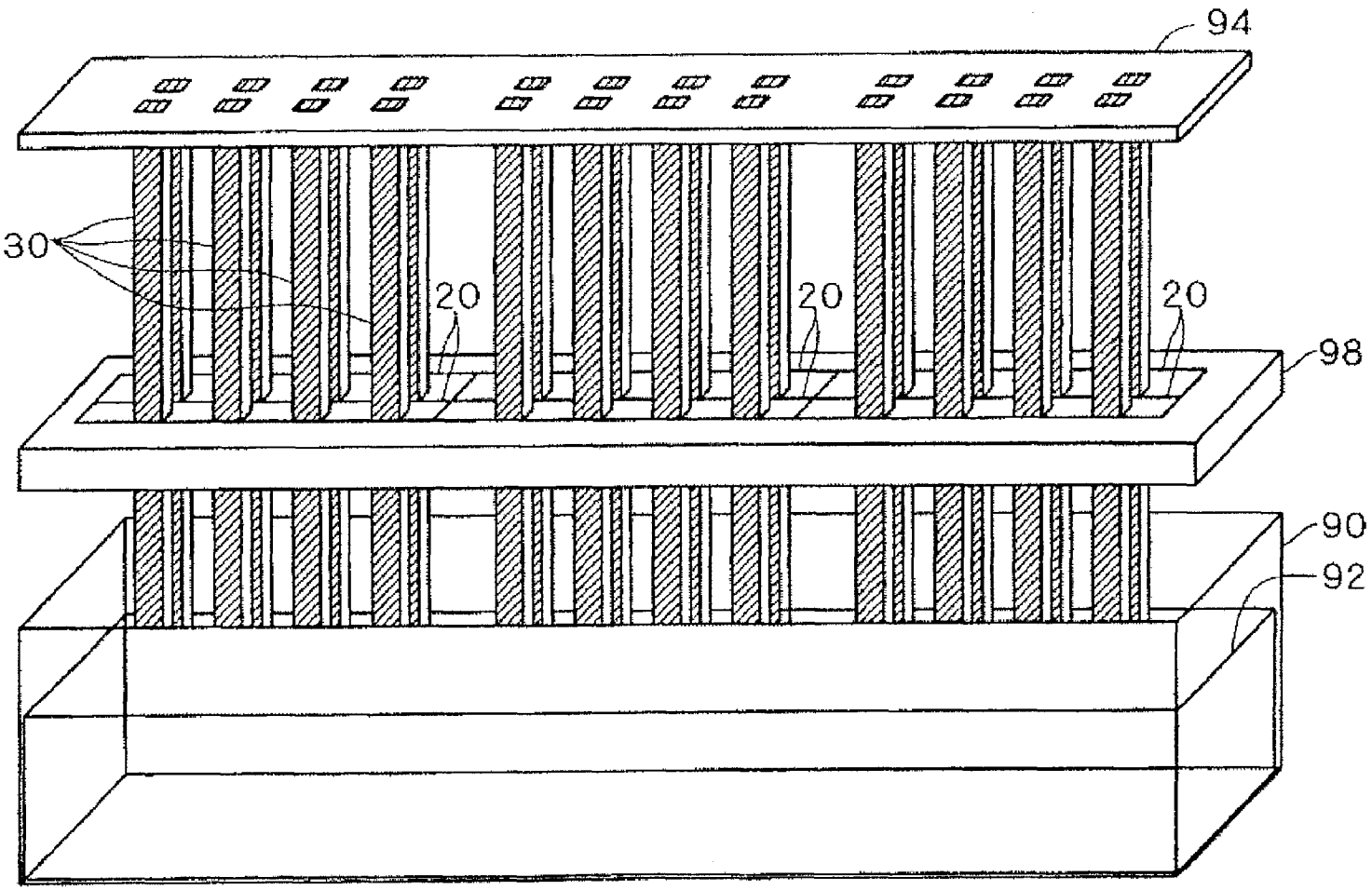
FIG. 24 is an explanatory view of a process for plating the terminals.

FIG. 24 is an explanatory view of a process for plating the terminals 30 in the above embodiment.

That is, there is a case where the terminals 30 must be plated. In this case, the terminals 30 can be plated by the following process.

That is, under the state in which the terminals 30 are held in the prealigner 20, one or more prealigners 20 are grasped, and ends of the terminals 30 are dipped in electrolyte 92 in a plating tank 90. In FIG. 24, a plurality of prealigners 20 (six prealigners, here) are disposed on the same plane, this assembly is held in a frame 98, and many terminals 30 can be plated at the same time. The other ends of the terminals 30 are contacted with one electrode 94 for electrically plating. Thus, metal ions in the electrolyte 92 are adhered to the one ends of the terminals 30 to effect plating of them.

Thus, it is possible to efficiently plate a plurality of terminals 30 held in the prealigner 20 all together.

Although the connector and the method for producing the same have been described above in detail, the above descriptions are examples with respect to all embodiments, and the present disclosure is not limited to the examples. Various alternative embodiments that are not described herein will fall into the present disclosure without departing from the sprit of the present disclosure.

What is claimed is:

1. A method of manufacturing a connector, comprising:

fitting a plurality of terminals into a plurality of terminal holding recesses provided in a prealigner, respectively, wherein the prealigner is formed into a substantially square bar-like configuration, each of the plurality of terminals has an inwardly directed end and an outwardly directed end, the terminal holding recesses are spaced apart from one another in a longitudinal direction of the prealigner; and molding a housing main body with flowing resin that solidifies so that the prealigner is interposed in the housing main body as an insert element, wherein the housing main body has a bottom and is formed into a substantially box-like configuration in which one side is open, the substantially box-like configuration defines an interior of the housing main body, the inwardly directed end of each of the terminals protrudes into the interior of the housing main body, the outwardly directed end of each of the terminals protrudes outward from the housing main body, and the prealigner is integrally incorporated on the bottom of the housing main body, wherein each side surface of the plurality of terminals is in contact with a side surface of a terminal holding recess or in contact with resin flowed into and solidified in an opening of the terminal holding recess.

2. The method of manufacturing a connector of claim 1, wherein the plurality of terminal holding recesses are configured to simultaneously fit a plurality of terminals having different diameters and lengths.

3. The method of manufacturing a connector of claim 1, wherein the terminals are made of an electrically conductive material and are formed into an elongated bar-like material.

4. A method of manufacturing a connector, comprising:

supplying wire rod from a wire rod supply unit;

applying either a continuous or an intermittent force to the wire rod to work the wire rod into a given cross-sectional shape or into latch portions, wherein the continuous or intermittent force is applied using a wire rod working device;

supplying the wire rod that has been worked into a given cross-sectional shape to a terminal press-fitting device to form a plurality of terminals, by cutting the wire rode into a given length;

supplying a prealigner to the terminal press-fitting device, pushing the plurality of terminals into a plurality of terminal holding recesses of the prealigner using a terminal pushing-in tool, press-fitting and holding the terminals into the terminal holding recesses;

transporting the prealigner to a molding device, and holding the plurality of terminals in the plurality of terminal holding recesses with the prealigner;

molding a housing main body so that the prealigner is interposed in resin as an insert element, wherein the molding is performed by the molding device;

securing the prealigner and the plurality of terminals to a plurality of molds and a core;

pouring molten resin into a space within the molds; and solidifying the molten resin and releasing molds.

5. The method of manufacturing a connector of claim 4, further comprising:

separately manufacturing the prealigner using a resin molding device.

6. A method of plating a plurality of terminals, comprising:

providing the plurality of terminals, each having a first and second end;

fitting the plurality of terminals into a plurality of terminal holding recesses provided in one or more prealigners;

grasping the one or more prealigners and dipping the first ends of the plurality of terminals into electrolyte, wherein the electrolyte is contained in a plating tank; and contacting the second ends of the plurality of terminals with one electrode, wherein the contacting of the second ends causes metal ions contained in the electrolyte to adhere to the first ends of the plurality of terminals.

* * * * *